US012765727B2

(12) United States Patent
Xiao et al.

(10) Patent No.: US 12,765,727 B2
(45) Date of Patent: Oct. 20, 2026

(54) PLASTIC BAG PULL-DOWN DEVICE FOR INTELLIGENT PACKAGING TOILET, AND INTELLIGENT PACKAGING TOILET

(71) Applicants: Jiangsu Sanjo Intelligent Technology Co., Ltd., Jiangsu (CN); Photon Robot (Ningbo) Co., Ltd., Zhejiang (CN)

(72) Inventors: Heping Xiao, Jiangsu (CN); Lei Wang, Jiangsu (CN); Jiang Zhang, Jiangsu (CN)

(73) Assignees: Jiangsu Sanjo Intelligent Technology Co., Ltd., Jiangsu (CN); Photon Robot (Ningbo) Co., Ltd., Zhejiang (CN)

( * ) Notice: Subject to any disclaimer, the term of this patent is extended or adjusted under 35 U.S.C. 154(b) by 107 days.

(21) Appl. No.: 18/882,665

(22) Filed: Sep. 11, 2024

(65) Prior Publication Data

US 2025/0082141 A1 Mar. 13, 2025

(30) Foreign Application Priority Data

Sep. 11, 2023 (CN) ..... 202311161934.9

(51) Int. Cl.
*A47K 13/24* (2006.01)

(52) U.S. Cl.
CPC ..... *A47K 13/24* (2013.01)

(58) Field of Classification Search
CPC ..... A47K 11/00; A47K 11/02–026; A47K 11/03–035; A47K 11/105; A47K 13/24; B65F 1/062
See application file for complete search history.

(56) References Cited

U.S. PATENT DOCUMENTS 4,519,104 A * 5/1985 Nilsson ..... A47K 11/026 4/484
9,079,710 B2 * 7/2015 Nakano ..... B65F 1/062
(Continued)

FOREIGN PATENT DOCUMENTS

CN 110063682 * 7/2019 ..... A47K 11/026
CN 111920333 * 11/2020 ..... A47K 11/026
(Continued)

*Primary Examiner* — David P Angwin
*Assistant Examiner* — Nicholas A Ros
(74) *Attorney, Agent, or Firm* — JCIPRNET

(57) ABSTRACT

The present disclosure relates to a plastic bag pull-down device for an intelligent packaging toilet, and an intelligent packaging toilet in the technical field of intelligent toilets. The plastic bag pull-down device includes two roller drive assemblies. Each of the roller drive assemblies includes a motor, a motor shaft, a housing, a first gear, a second gear, a first roller, and a second roller. The motor is mounted on an outer surface of the housing and is connected to the first gear through the motor shaft. The first gear is connected to the first roller and is engaged with the second gear. The second gear is rotatably mounted on a transmission shaft inside the housing and is connected to the second roller. The present disclosure realizes the pull-down and replacement of the plastic bag of the intelligent packaging toilet. In addition, the plastic bag pull-down device of the present disclosure is independently driven by two motors, so that more free and diversified control methods can be realized, thereby solving the problem that existing plastic bag pull-down devices are complex and cannot pull downward the plastic bag to an expected position.

3 Claims, 4 Drawing Sheets

(56) References Cited

U.S. PATENT DOCUMENTS

| | | | | |
|---|---|---|---|---|
| 9,598,194 | B2 * | 3/2017 | Shimanuki | B65F 1/062 |
| 11,974,703 | B2 * | 5/2024 | Luettgen | A47K 11/026 |

FOREIGN PATENT DOCUMENTS

| | | | | |
|---|---|---|---|---|
| CN | 116331695 | * | 6/2023 | B65F 1/062 |
| KR | 20170139960 | * | 12/2017 | A47K 11/026 |

* cited by examiner

PLASTIC BAG PULL-DOWN DEVICE FOR INTELLIGENT PACKAGING TOILET, AND INTELLIGENT PACKAGING TOILET

CROSS-REFERENCE TO RELATED APPLICATION

This application claims the priority benefit of China application serial no. 202311161934.9, filed on Sep. 11, 2023. The entirety of the above-mentioned patent application is hereby incorporated by reference herein and made a part of this specification.

TECHNICAL FIELD

The present disclosure relates to the technical field of intelligent toilets, and particularly to a plastic bag pull-down device for an intelligent packaging toilet, and an intelligent packaging toilet.

BACKGROUND

Toilets are indispensable bathroom products in families. With the development of technologies, intelligent toilets with diversified functions, such as constant temperature, cleansing, automatic packaging, etc. have been developed. The appearance of such toilets has greatly improved user experience.

At present, there are generally two types of toilets on the market: flush toilets and non-flush toilets. The portability and operability of flush toilets are not as good as those of non-flush toilets. Non-flush toilets generally use bags to package excrement for disposal. Manual placement of bags is troublesome and has hygiene problems, so automatic replacement of plastic bags is often used. Suction-based bag placement and roller-driven bag placement are two methods commonly used to replace plastic bags in intelligent toilets. For the suction-based bag placement method, negative pressure is formed between the plastic bag and the bowl by exhausting air using a fan, and the plastic bag is forced into the bowl by atmospheric pressure. However, due to the complex structure in the bowl, greater pressure is required for the introduction and spreading of the plastic bag in the bowl. As a result, the plastic bag cannot be placed down to an expected position, and various parts of the plastic bag are likely to be contaminated. For the roller-driven bag placement method, a motor is used to synchronously drive gear transmission mechanisms on two sides by connecting rods, to drive the rollers to rotate. Because there is a squeezing force between the rollers, the plastic bag can be pulled downward and replaced by friction. However, the connecting rod transmission has to be arranged in front or back, leading to a long transmission path and high energy consumption by friction between the gears. In addition, errors of gear manufacturing will result in poor reliability.

SUMMARY

To solve the problem of poor effect of plastic bag pull-down devices of existing intelligent packaging toilets, the present disclosure provides a plastic bag pull-down device for an intelligent packaging toilet, and an intelligent packaging toilet. The technical solution of the present disclosure is implemented as follows.

A plastic bag pull-down device for an intelligent packaging toilet is provided, including two roller drive assemblies, where each of the roller drive assemblies includes a motor, a motor shaft, a housing, a first gear, a second gear, a first roller, and a second roller, the motor is mounted on an outer surface of the housing and is connected to the first gear through the motor shaft, the first gear is connected to the first roller and is engaged with the second gear, and the second gear is rotatably mounted on a transmission shaft inside the housing and is connected to the second roller.

Preferably, each of the roller drive assemblies further includes a torsion spring and a limiting bump; where the torsion spring is sleeved on a fixed column in the housing, a first end of the torsion spring is limited to an inner wall of the housing, a second end of the torsion spring is pressed against the limiting bump in the housing, and a circular hole on a side of the limiting bump is connected to the transmission shaft.

Preferably, the first roller and the second roller are each wrapped with a rubber material.

An intelligent packaging toilet is provided, including a base, a toilet seat, and the plastic bag pull-down device, where the two roller drive assemblies are respectively mounted on two sides of a bottom of the toilet seat.

The motor is a direct-current (DC) gear motor.

In the present disclosure, two DC gear motors are used to respectively drive the rubber rollers on the two sides. Synchronous rotation of the two motors is realized through model selection and a reasonable control strategy. A single pair of gears is used on each side to realize the rotation of the two rollers in opposite directions, thereby solving the problems of poor plastic bag pull-down and replacement effects of existing intelligent packaging toilets. The plastic bag pull-down device for the intelligent packaging toilet involves a simple structure, low costs, a higher space utilization, and improved implementation effects.

BRIEF DESCRIPTION OF THE DRAWINGS

In order to more clearly explain the technical solutions in the embodiments of the present disclosure or in the prior art, the drawings used in the description of the embodiments or the prior art will be briefly described below. Obviously, the drawings depicted below are merely an embodiment of the present disclosure, and those skilled in the art can obtain other drawings based on these drawings without any creative efforts.

Like parts and components are denoted by like reference numerals. It should be noted that the terms such as "front", "rear", "left", "right", "upper", and "lower" used in the following description refer to directions in the drawings, and the terms such as "bottom surface", "top surface", "inner", and "outer" respectively refer to directions toward or away from the geometric center of a particular component.

Figure 1:
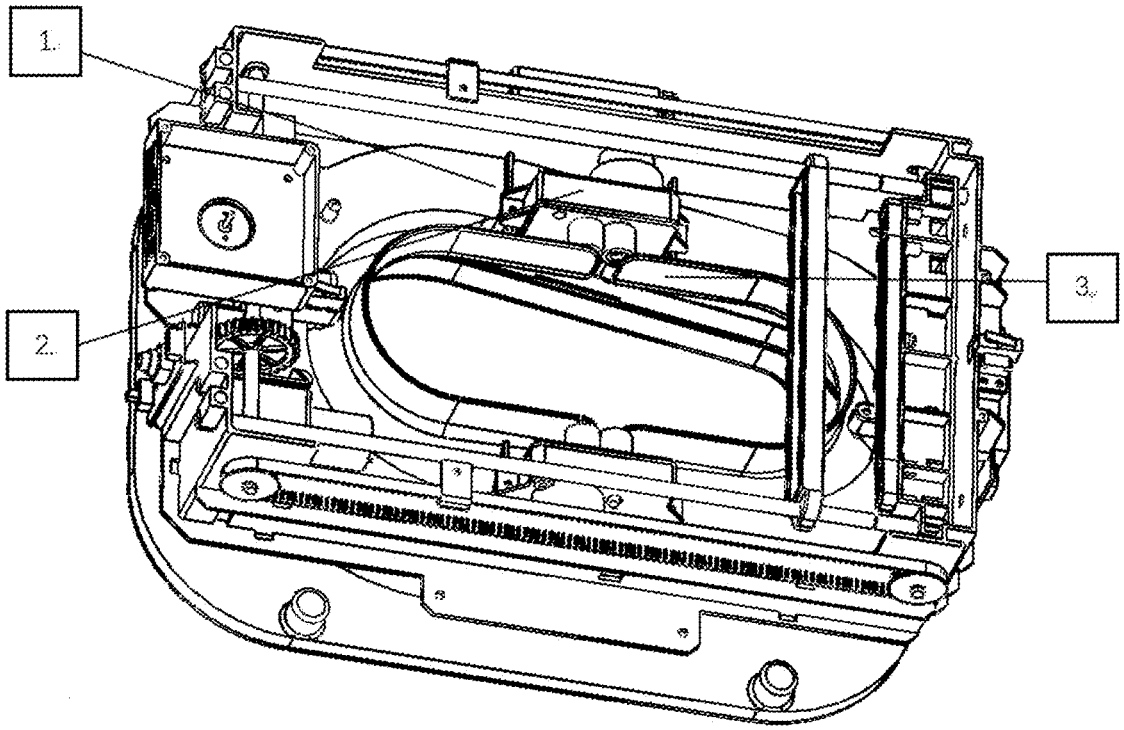
FIG. 1 is a schematic structural diagram of an embodiment of an intelligent packaging toilet.

In the drawings, the reference numerals respectively represent:

1. base;

2. roller drive assembly;

2-1. motor; 2-2. motor shaft; 2-3. housing; 2-4. first gear; 2-5. second gear; 2-6. first roller; 2-7. second roller; 2-8. transmission shaft; 2-9. torsion spring; 2-10. limiting bump;

3. toilet seat.

DETAILED DESCRIPTION OF THE EMBODIMENTS

The technical solutions in the embodiments of the present disclosure will be described clearly and fully with reference to the accompanying drawings in the embodiments of the present disclosure. Apparently, the embodiments described are merely some embodiments, rather than all of the embodiments of the present disclosure. All other embodiments obtained by a person of ordinary skill in the art without creative efforts based on the embodiments of the present disclosure shall fall within the protection scope of the present disclosure.

Embodiments

In a specific embodiment, as shown in FIG. 1, an intelligent packaging toilet includes a base 1, a toilet seat 3, and a plastic bag pull-down device. The plastic bag pull-down device includes two roller drive assemblies 2. The plastic bag pull-down device is mounted on the base 1. A circular through hole is provided in the middle of the base 1 for a plastic bag to pass through. The two roller drive assemblies 2 in the plastic bag pull-down device are respectively mounted on two sides of the circular through hole and fixed to the base 1 by screws.

Figure 2:
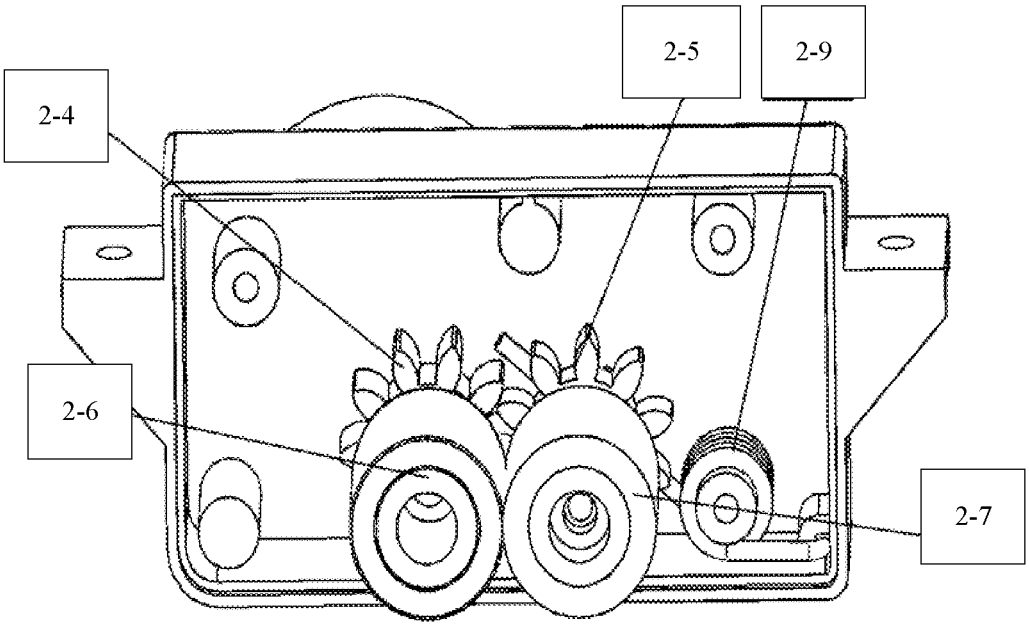
FIG. 2 is a schematic structural diagram of an embodiment of a roller drive assembly.
Figure 3:
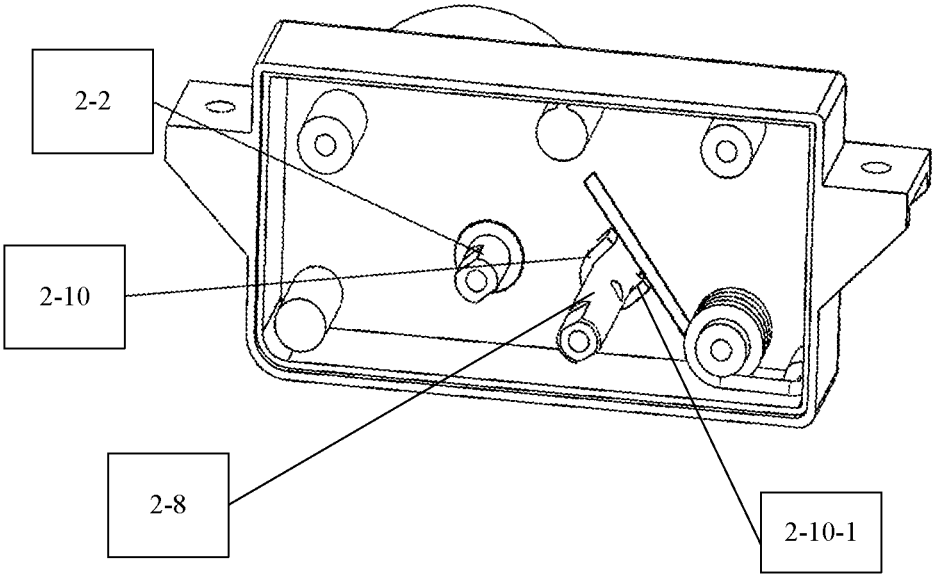
FIG. 3 is a schematic structural diagram of an embodiment of a roller drive assembly (where no gear or roller is shown).
Figure 4:
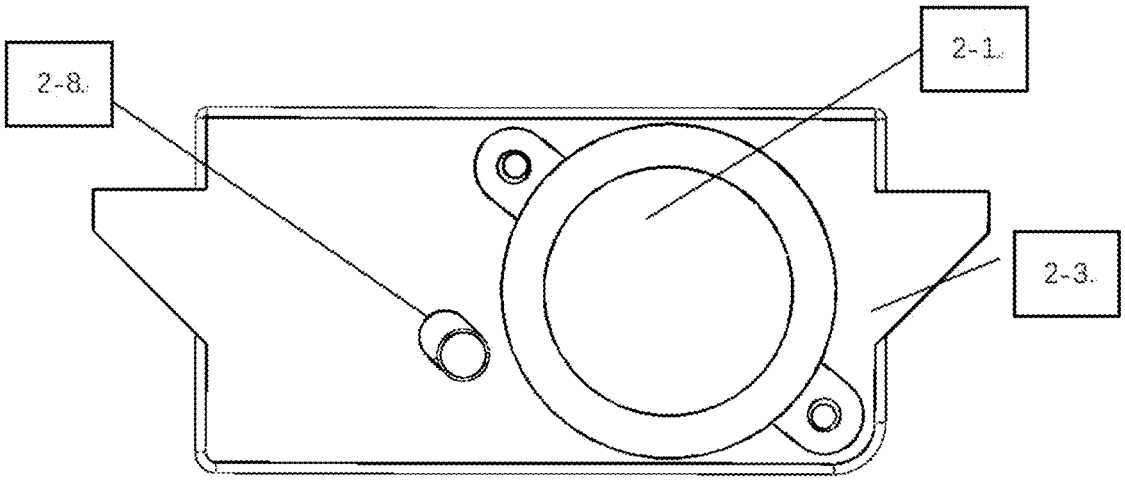
FIG. 4 is a schematic structural diagram of a rear side of an embodiment of a roller drive assembly.

As shown in FIG. 2 to FIG. 4, each of the roller drive assemblies 2 includes a motor 2-1, a motor shaft 2-2, a housing 2-3, a first gear 2-4, a second gear 2-5, a first roller 2-6, and a second roller 2-7. The motor 2-1 is mounted on an outer surface of the housing 2-3 and is connected to the first gear 2-4 through the motor shaft 2-2. The first gear 2-4 is connected to the first roller 2-6 and is engaged with the second gear 2-5. The second gear 2-5 is rotatably mounted on a transmission shaft 2-8 inside the housing 2-3 and is connected to the second roller 2-7. Each of the roller drive assemblies 2 further includes a torsion spring 2-9 and a limiting bump 2-10. The torsion spring 2-9 is sleeved on a fixed column in the housing 2-3. A first end of the torsion spring 2-9 is limited to an inner wall of the housing 2-3, and a second end of the torsion spring 2-9 is pressed against the limiting bump 2-10. The limiting bump 2-10 is connected to transmission shaft 2-8. The limiting bump 2-10 comprises a curved recess 2-10-1 and the transmission shaft 2-8 is received in the curved recess 2-10-1. The first roller 2-6 and the second roller 2-7 are each wrapped with a rubber material. The motor 2-1 is a DC gear motor 2-1. The two roller drive assemblies 2 are respectively mounted on two sides of a bottom of the toilet seat 3.

In this embodiment, the roller drive assemblies 2 on the two sides are respectively driven by their respective motors 2-1. The motor 2-1 drives the first gear 2-4 and the second gear 2-5 inside the housing 2-3 to rotate, to drive the first roller 2-6 and the second roller 2-7 to rotate, so as to pull downward and rotate the plastic bag. A middle position of the first roller 2-6 and the second roller 2-7 is mounted corresponding to an inner ring of the toilet to realize the pull-down and replacement of the plastic bag.

The first gear 2-4 is fixed to the motor shaft 2-2 and connected to the first roller 2-6 by a D-type key connection. The second gear 2-5 and the second roller 2-7 are connected to the transmission shaft 2-8. The first roller 2-6 and the second roller 2-7 are each wrapped with a rubber material to increase the friction and provide certain deformation ability. The connection mode between the second gear 2-5 and the transmission shaft 2-8 is pin connection. The second gear 2-5 is fixed in a pin hole on the transmission shaft 2-8. The second roller 2-7 is connected to the transmission shaft 2-8 by a D-type key. The first gear 2-4 and the second gear 2-5 mesh with each other in the housing 2-3. The first gear 2-4 drives the second gear 2-5 to respectively drive the first roller 2-6 and the second roller 2-7 to rotate. The transmission shaft 2-8 is fixed in a slot hole on the housing 2-3, and the transmission shaft 2-8 is axially positioned by the limiting bump 2-10 and the torsion spring 2-9. The motor 2-1 is fixed in a hole on the housing 2-3 by a bolt. During the operation of the plastic bag pull-down device, the two rollers need to provide certain friction and squeezing so that the plastic bag can be normally pulled downward and replaced. However, if shafts of the two rollers are configured in a completely fixed form, the rollers will be relaxed due to the wear and aging of rubber after a period of use, resulting in the failure of the pull-down mechanism. Moreover, after installation, the positions of the two rubber rollers stick together and are inseparable, making it very difficult for the plastic bag to enter between the rollers. Therefore, during the arrangement of the transmission shaft 2-8, a hole for positioning the transmission shaft 2-8 on the housing 2-3 is configured as a slot hole, to provide a space for movement of the transmission shaft 2-8, so that the transmission shaft 2-8 can slide to a certain extent in the slot hole. In addition, the torsion spring 2-9 is arranged to press against the transmission shaft 2-8, to provide a pre-tightening force between the two rollers to prevent loosening of the two rollers. To implement packaging for the first time, a plastic bag needs to be manually pressed into between the rollers, and the movable shafts will be separated when pushed by the external force, so that the two rollers are separated from each other to facilitate placement of the plastic bag.

In the actual working process, to place a plastic bag for the first time, the user needs to manually place the plastic bag into between the two rollers on each side, and the plastic bag is pulled downward by a squeezing force and a friction force between the rollers. Because the transmission shafts 2-8 of the two second rollers 2-7 are fixed by the torsion springs 2-9, the two rollers can be separated with a small force during use, and then the plastic bag can be placed into between the rollers. The motors 2-1 on both sides rotate to drive the gears to rotate, to drive the rollers to rotate to realize the pull-down of the plastic bag.

It should be noted that the foregoing descriptions are merely some embodiments of the present disclosure, but are not to limit the present disclosure. Any modification, equivalent replacement, and improvement made within the spirit and principle of the present disclosure shall fall within the protection scope of the present disclosure.

What is claimed is:

1. A plastic bag pull-down device for an intelligent packaging toilet, comprising two roller drive assemblies, wherein each of the roller drive assemblies comprises a motor, a motor shaft, a housing, a first gear, a second gear, a first roller, and a second roller, the motor is mounted on an outer surface of the housing and is connected to the first gear through the motor shaft, the first gear is connected to the first roller and is engaged with the second gear, and the second gear is rotatably mounted on a transmission shaft inside the housing and is connected to the second roller, wherein each of the roller drive assemblies further comprises a torsion spring and a limiting bump, wherein the torsion spring is sleeved on a fixed column in the housing, a first end of the torsion spring is limited to an inner wall of the housing, a second end of the torsion spring is pressed against the limiting bump, and the limiting bump comprises a curved recess, and the transmission shaft is received in the curved recess.

2. The plastic bag pull-down device for the intelligent packaging toilet according to claim 1, wherein the first roller and the second roller are each wrapped with a rubber material.

3. An intelligent packaging toilet, comprising a base and a toilet seat, and further comprising the plastic bag pull-down device for the intelligent packaging toilet according to claim 1, wherein the two roller drive assemblies are respectively mounted on two sides of a bottom of the toilet seat.

* * * * *